US006397709B1

(12) United States Patent
Wall

(10) Patent No.: US 6,397,709 B1
(45) Date of Patent: Jun. 4, 2002

(54) HANDTOOL WITH ROTATABLE ARMS

(76) Inventor: Dean Wall, 11106 Susan Dr., Sandy, UT (US) 84092

( * ) Notice: Subject to any disclaimer, the term of this patent is extended or adjusted under 35 U.S.C. 154(b) by 0 days.

(21) Appl. No.: 09/374,329

(22) Filed: Aug. 13, 1999

(51) Int. Cl.[7] ..... B25B 23/00
(52) U.S. Cl. ..... 81/440; 81/177.4; 81/177.5
(58) Field of Search ..... 81/177.4, 177.7, 81/440, 436–439, 177.5, 177.6, 177.8, 177.9, 177.2

(56) References Cited

U.S. PATENT DOCUMENTS

RE10,145 E * 7/1882 Chantrell ..... 81/124.4 X
2,726,695 A * 12/1955 Malm ..... 81/440
4,542,667 A * 9/1985 Jang ..... 81/177.6 X
4,848,197 A * 7/1989 Kikel ..... 81/177.5 X
4,934,221 A * 6/1990 Hsiao ..... 81/177.5
5,228,363 A * 7/1993 Corona et al. ..... 81/177.4 X
6,029,549 A * 2/2000 Baker ..... 81/177.4 X

* cited by examiner

*Primary Examiner*—Joseph J. Hail, III
*Assistant Examiner*—Anthony Ojini
(74) *Attorney, Agent, or Firm*—Jon C. Christiansen

(57) ABSTRACT

This invention is a handtool having an elongated member and two arms rotatably attached to an end of the elongated member. The elongated member is adapted to hold a bit at an its end. The first arm can be rotated about its fixed point to a position that is substantially perpendicular to the elongated member. The first arm can also be rotated about its fixed point from its perpendicular position towards the elongated member. Similarly, the second arm can be rotated about its fixed point to a position that is substantially perpendicular to the elongated member and the second arm can be rotated about its fixed point from its perpendicular position towards the elongated member. Each of the arms can be rotated independent of the rotation of the other arm.

43 Claims, 4 Drawing Sheets

HANDTOOL WITH ROTATABLE ARMS

This invention relates to handtools. The inventive handtool is a handtool having rotatable arms and can be used with a variety of bits to provide a multiple tool capability.

The prior art includes many hand-held tools (handtools) with bits intended to accomplish a variety of purposes. For example, a prior art multiple bit handtool which can assume a T-driver shape is disclosed in U.S. Pat. No. 4,848,197 entitled "Multiple Bit Handtool" issued Jul. 18, 1989. U.S. Pat. No. 4,848,197 and its disclosures and drawings are incorporated herein by this reference to facilitate the disclosure and teaching of my new invention.

The prior art also includes "4 in 1" screwdrivers having a handle and a bit holding blade. The blade can be reversible and can hold a double headed bit on each end of the blade. Each double headed bit offers two tools (e.g., a Phillips and a slotted tool or head). With two double headed bits, the prior art "4 in 1" screwdriver offers 4 tools in one tool (thus its name).

It is an object of the invention to provide a handtool with independently rotatable arms that provide increased functionality and flexibility to the handtool.

It is another objection of the invention to provide a handtool which can have a multiple bit tool capability.

These and other objectives, advantages and aspects of the invention are described in the following descriptions and drawings of the invention.

SUMMARY OF THE INVENTION

The handtool of this invention has an elongated member adapted to hold a bit at an end of said elongated member, a first arm rotatably attached at a fixed point to said elongated member, and a second arm rotatably attached at a fixed point to said elongated member. The first arm is rotatable about its fixed point to a position that is substantially perpendicular to the elongated member. The first arm is also rotatable about its fixed point from its perpendicular position towards the elongated member. Similarly, the second arm is rotatable about its fixed point to a position that is substantially perpendicular to the elongated member and said second arm is rotatable about its fixed point from its perpendicular position towards the elongated member. Each of the arms can be rotated independent of the rotation of the other arm. Other inventive aspects of the invention are described below, but not all of which are requirements for every embodiment of the invention or its practice.

The first arm and the second arm are rotatable on opposite sides of the elongated member. The first arm and second arm can simultaneously be in their perpendicular positions to form with the elongated member a T shape which can be hand-held and which provides increased torque for turning a bit at the end of said elongated member. A handtool in accordance with claim 1 wherein said first arm is adapted to hold a bit at an end of said first arm and said second arm is adapted to hold a bit at an end of said second arm; and wherein the bit holding end of each arm is opposite the fixed point at which the arm is rotatably attached.

The elongated member can be adapted to receive, hold and release a bit at the bit holding end of said elongated member, the first arm can be adapted to receive, hold and release a bit at the bit holding end of the first arm, and the second arm can be adapted to receive, hold and release a bit at the bit holding end of the second arm.

Preferably, the elongated member has a first open portion adapted to receive the first arm when it is rotated into the elongated member, and the elongated member has a second open portion adapted to receive the second arm when it is rotated into the elongated member.

Preferably, the elongated member is comprised of a handle and a blade. The first arm and second arm are rotatably attached to the handle. The blade extends from the handle and includes the bit holding end of the elongated member. Preferably, the handle is adapted to receive, hold and release the blade and the blade is reversible and is adapted to hold a bit on each end of the blade.

The handle can have ribs extending from said handle and running parallel to the length of said handle. The ribs can be rounded, and if desired, the rounding can be truncated in a manner that defines a circle shape. The exposed portions of said arms can serve as ribs when the arms are in the closed position. The exposed portions of the arms should substantially conform in size and shape to the ribs when said arms are positioned in said open portions.

One or both of the arms can be rotated away from the elongated member and beyond a perpendicular position to one or more extended positions relative to the elongated member. A mechanism can be used to secure an arm to one or more pre-determined positions, including extended positions.

THE DRAWINGS

DETAILED DESCRIPTION OF INVENTION, INCLUDING PREFERRED EMBODIMENT

Figure 4:
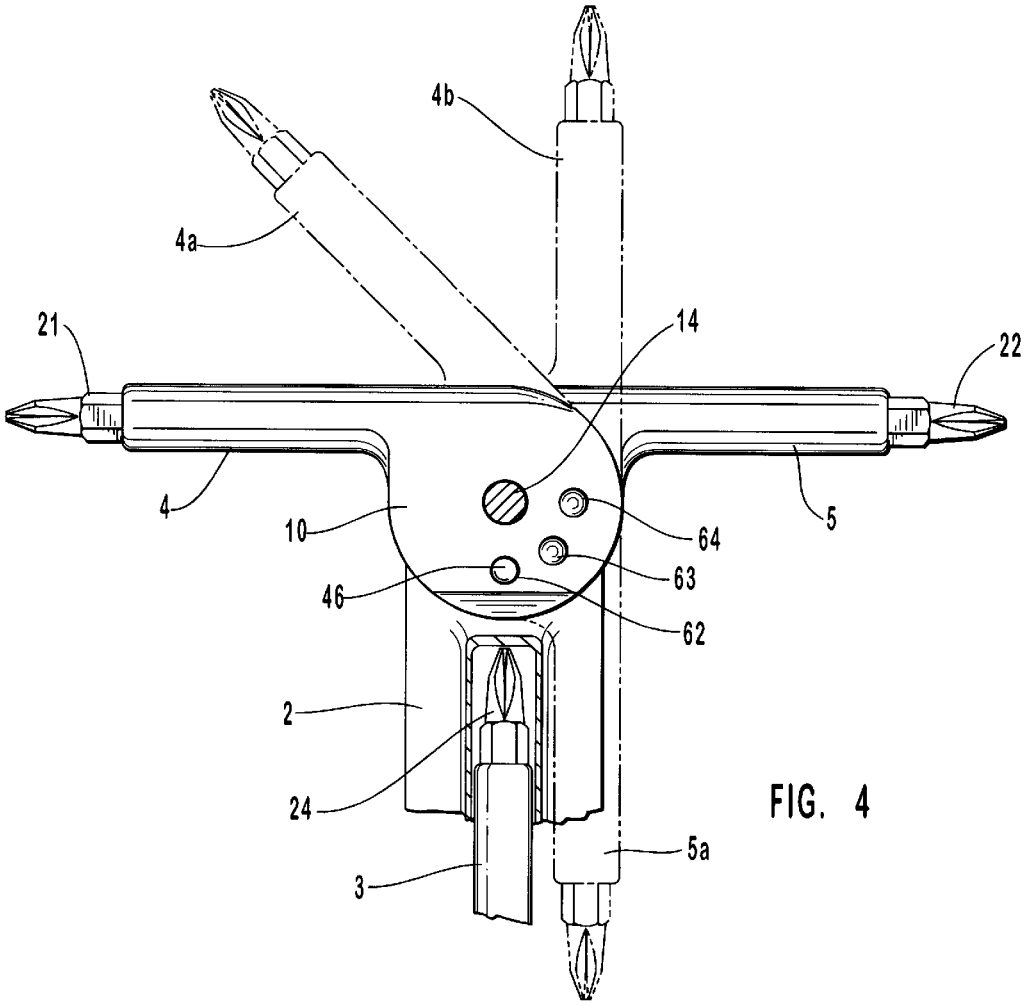
FIG. 4 is a side view of the inventive handtool showing an arms in various perpendicular, extended and closed positions.
Figure 5:
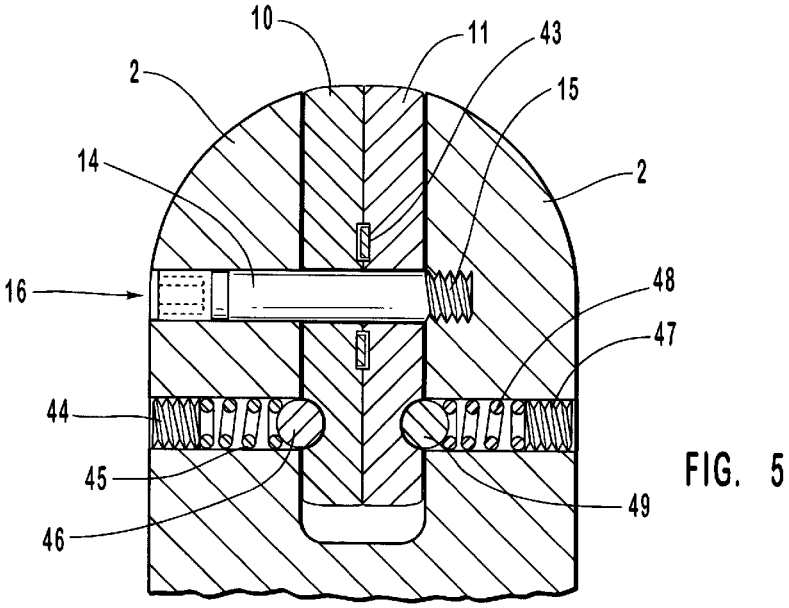
FIG. 5 is an internal view of the end the handle and shows the pin used to attach the plates to the handle and the spring, ball and detents mechanism for securing an arm to predetermined positions.
Figure 6:
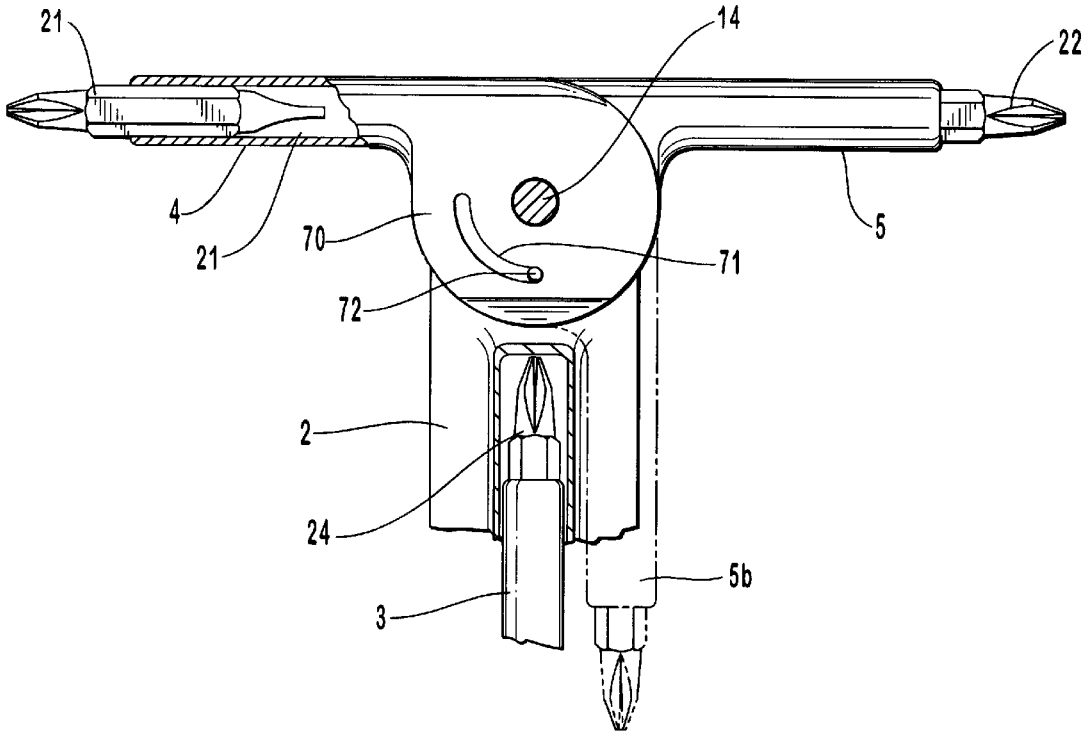
FIG. 6 shows an alternative embodiment of the inventive handtool having a pin and slot mechanism to restrict rotation of an arm.

The presently preferred embodiment of the inventive handtool is depicted in FIGS. 1, 2, 3, 4, 5 and 7. An alternative embodiment is depicted in FIG. 6.

Figure 1:
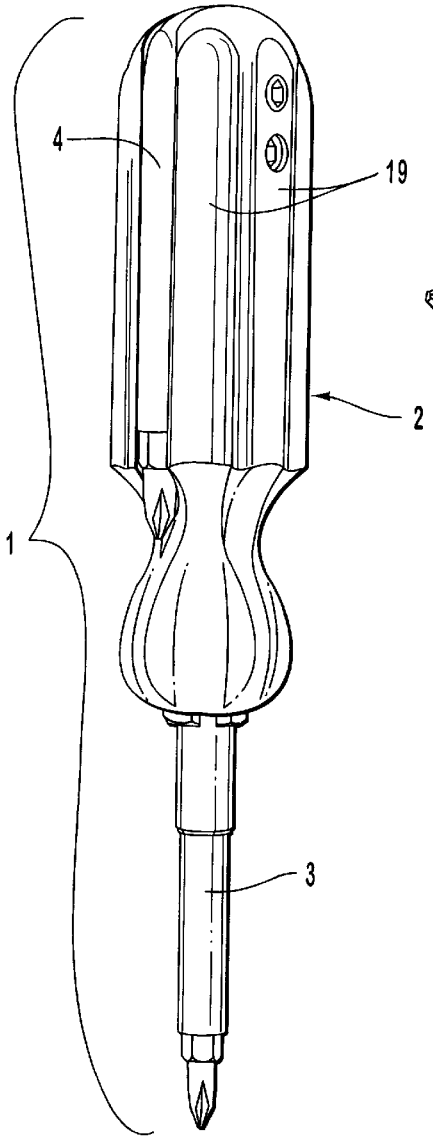
FIG. 1 depicts an embodiment of the inventive handtool with the arms in a closed position.
Figure 2:
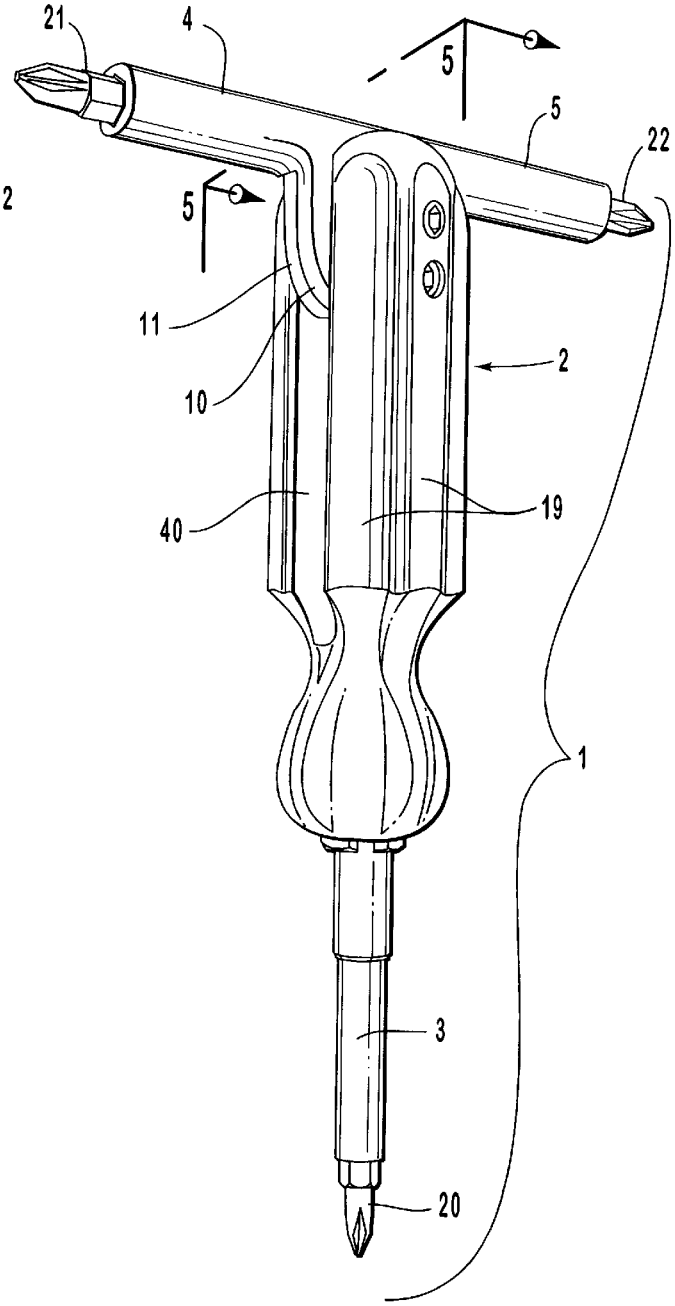
FIG. 2 depicts an embodiment of the inventive handtool with the arms in a perpendicular position.
Figure 7:
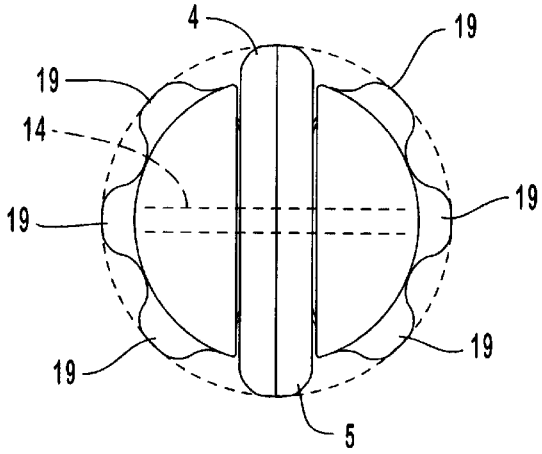
FIG. 7 depicts an end view of the handle of the inventive handtool.

An elongated member shown generally by the numeral 1 in FIG. 1 is formed by a handle 2 and a blade 3. Blade 3 is adapted to hold a bit 20 at the end of the blade. In other embodiments (not shown in the drawings) of this invention, the elongated member can be formed by other components which may be integral or may otherwise be affixed to each other, provided that the elongated member is substantially longer in length than it is in width or diameter and further provided that the elongated member be adapted to hold a bit at one of its ends. The elongated member preferably has a substantially circular cross-section, but can have other cross-sectional shapes, e.g., rectangular, triangular, oval or other-shaped cross-sections. In this preferred embodiment, the cross-section of the handle 2 is substantially circular as shown in FIG. 7, and the cross-section of blade 3 is substantially circular (because blade 3 is substantially in a cylindrical form as shown in FIGS. 1 and 2). Furthermore, the cross-sectional size and shape of the elongated member may be different for different portions of the elongated member, as is the case in the shown preferred embodiment of this invention.

The handle 2 can be any shape or size that provides the function of a handle, i.e., that facilitates a hand grip. Preferably, the handle includes ribs 19 running along and parallel to length of the handle as shown in FIGS. 1, 2, and 7. These ribs 19 are extensions from the handle and are positioned to make contact with a hand grip on the handle. Preferably, these extensions are substantially rounded at the upper areas which come in contact with the hand. As shown in FIG. 7, the rounding of the ribs 19 can be truncated to form or define a circular shape as shown by the dotted lines. If the ribs were not truncated, but were fully rounded, the outer ends of the extensions would extend beyond the circle defined by the dotted lines. In this manner the ribs of the preferred embodiment are rounded, but the rounding is truncated to form or define a outer circle. The handle 2 is preferably constructed of plastic, but can be metal or any other material suitable to serve the function of a handle. Plastics generally used in the construction of plastic handles for screwdrivers can be used.

The blade 3 can be, and preferably is, any of the conventional blades or shafts well known to persons of ordinary skill in the art, including those used in prior art "4 in 1" handtools or screwdrivers. Unconventional blades or shafts can also be used as the blade in the practice of this invention. The primary requirements of the blade are that it can hold a bit at its end and that it can be affixed to a handle. Handle 2 is adapted to hold blade 3, and preferably to receive, hold and release blade 3. This can be accomplished in any conventional or known manner such as in prior art "4 in 1" handtools or screwdrivers, or in any other manner. To receive blade 3, the end of handle 2 can be sized and shaped to allow insertion of the blade into the handle. To hold blade 3, the handle 2 can provide a fit, including slots and an internal groove, adapted to the handle and blade 3 can have a spring loaded ball that snaps to the internal groove and side wings or extensions that are inserted through the slots. This can be accomplished or facilitated by any mechanism known now or in the future which is suited to this purpose. To release blade 3, the handle can allow for removal of blade 3 by hand (e.g., the user can pull the blade out of the handle) or the handle can provide for any other mechanism of release known now or in the future suited to this purpose. Preferably, blade 3 is a reversible blade. A reversible blade can hold a bit at either of its ends. Blade 3 holds a bit 20 at one end of the blade (see FIG. 2) and a bit 24 at the other end of the blade (see FIG. 4). Blade 3 can be removed from handle 2 and reversed with the opposite end of blade 3 then being inserted into handle 2. The blade 3 can be metal, but can be any other material suitable to serve the function of a blade. The metals used in the construction of removable or reversible blades in prior art "4 in 1" handtools or screwdrivers can be used in the practice of this invention.

Arm 4 and arm 5 are rotatably attached to elongated member 1. Although arms 4 and 5 are substantially cylindrical (i.e. substantially circular cross-section) this is not a requirement of the invention. The elongated members may have rectangular, triangular, oval or other-shaped cross-sections. Furthermore, the cross-sectional size and shape of a arm may be different for different portions of the arm. The arms can be constructed of steel, aluminum or can be zinc die cast, or can be constructed of any other material suitable to serve the function of an arm. Zinc die cast with nickel plating, steel and aluminum are preferred materials of arm construction.

Figure 3:
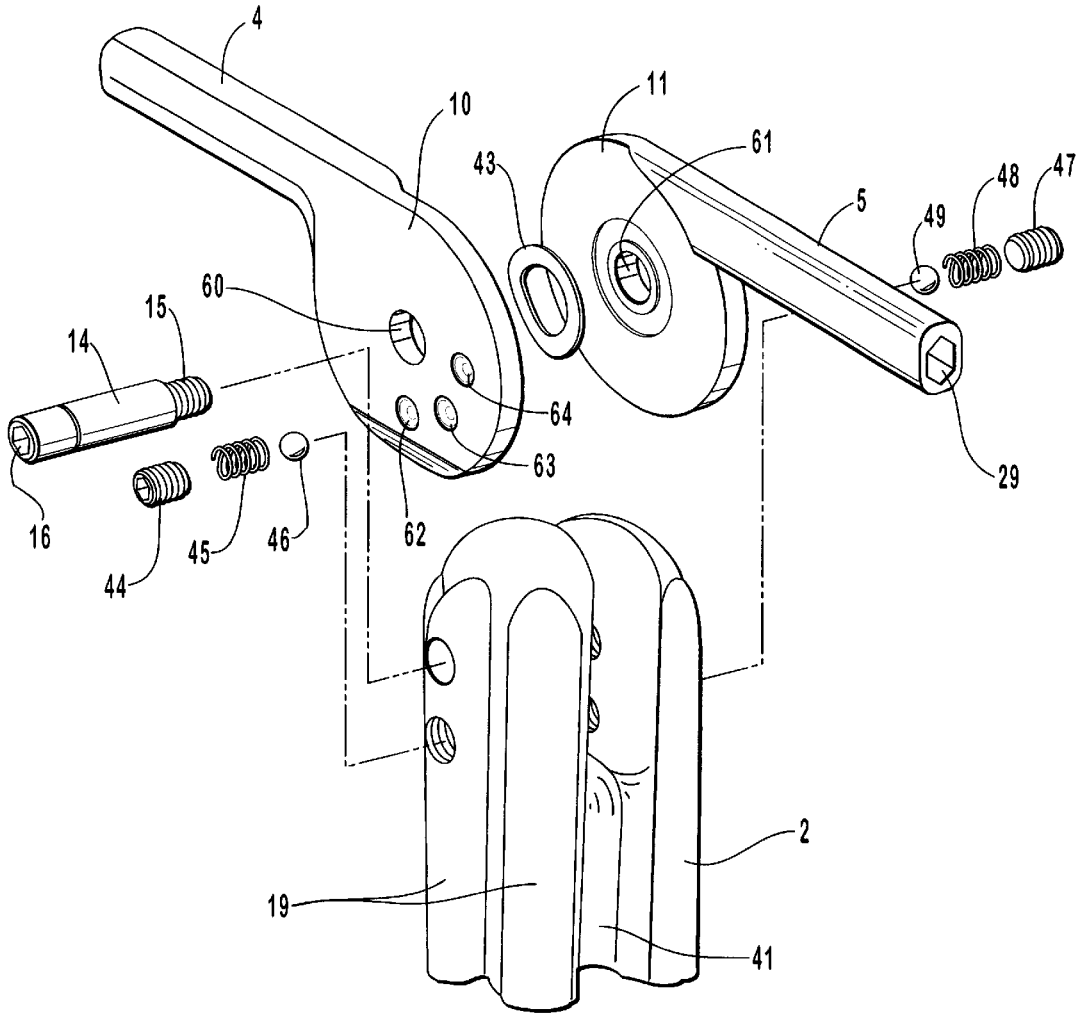
FIG. 3 depicts the arms and the components used to attach the arms to the handle of this embodiment of the inventive handtool. The spring, ball and detents mechanism for securing an arm to pre-determined positions is also shown.

Arm 4 and arm 5 are rotatably attached to elongated member 1 in the following manner. A plate 10 is affixed to arm 4. In this embodiment, plate 10 is integral with arm 4 and forms a single integral piece comprised of a arm portion 4 and a plate portion 10. Similarly, a plate 11 is affixed to arm 5. In this embodiment, plate 11 is integral with arm 5 and forms a single integral piece comprised of a arm portion 5 and a plate portion 11. In other embodiments, the plate can be affixed to the arm by means other than making the plate and arm an integral piece, including, without limitation, any manner of attachment known now or in the future. Furthermore, in various embodiments of the invention the arm can be attached directly to the elongated member or can be attached indirectly through an intermediary mechanism to the elongated member. In this preferred embodiment, Pin 14 is positioned through handle 2 and plates 10 and 11 as shown in FIG. 5. Note that pin 14 does not extend entirely through handle 2. Preferably, a washer 43 (e.g., wave washer) is placed between plates 10 and 11 as shown in FIG. 3. The end of pin 14 includes a threaded portion 15 which can be screwed into a threaded hole in handle 2 adapted to receive the threaded portion 15 of pin 14. The opposite end 16 of pin 14 has a hexagonal-shaped opening to allow an Allen wrench (not shown) to be used to screw pin 14 (including threaded portion 15) into handle 2. Pin 14 (at its intersection with the plate) defines a fixed point at which the arm is attached to handle 2 and a fixed point about which the arm rotates. Pin 14 can be a spring pin or roll pin with a bushing thereby eliminating 15 and 16 from the pin, i.e., a bushing can be inserted into the holes of plates 10 and 11 and the pin can be press fit through handle 2 and through the bushing. Mechanisms known now or later other than a plate and pin can be used to rotatably attach the arms to the elongated member. Plates 10 and 11 are preferably constructed of the same material as the arms, but can be of a different material suited to serve the function of a plate. The pin is preferably constructed of steel, but other suitable materials can be used.

As each arm 4 or 5 rotates, its plates 10 or 11 also rotates. Plates 10 and 11 are parallel to each other as shown in FIGS. 2, 3, and 5. Plates 10 and 11 rotate about the same axis of rotation. In this embodiment they rotate about pin 14 and the axis of rotation is defined by pin 14 (or the cylindrical axis of the substantially cylindrically shaped pin 14).

Each plate 10 or 11 is sized and shaped (in this case rounded) such that as the plate rotates the plate remains substantially flush with the end of handle 2 (i.e., the end opposite the end that holds blade 3). Substantially flush means that as the plate rotates it does not extend substantially beyond the end of handle. This can be seen in FIG. 5 where plates 10 and 11 do not extend substantially beyond the end of handle 2 despite rotation of the plates.

As shown in FIG. 3, the thickness of each plate 10 or 11 is about one-half the thickness (i.e., diameter or other width) of the arm 4 or 5 to which the plate 10 or 11 is affixed.

As shown in the FIGS. 2, 3, and 4, arm 4 and arm 5 are rotatable on opposite sides of elongated member 1 (handle 2 and blade 3). Although the arc of rotation of the arms overlaps at the higher extended positions attainable by the arms, the rotation of each arm is primarily restricted to its side of elongated member 1. In other words and as shown in FIG. 4, arm 4 is rotatable on one side (i.e., the left side in FIG. 4) of elongated member 1 and arm 5 is rotatable on the opposite side (i.e., the right side in FIG. 4) of elongated member 1. Thus, the arms are rotatable on opposite sides of elongated member 1.

An end of arm 4 is adapted to hold bit 21. An end of arm 5 is adapted to hold bit 22. An end of blade 3 is adapted to hold bit 20. The other end of blade 3 is adapted to hold bit 24. In each case, this can be accomplished by an opening at the end of the arm or blade that holds the bit or by otherwise securing (temporarily or permanently) the bit to the end of the arm or blade by any mechanism known now or in the future. In this preferred embodiment of the invention, the opening has a hexagonal cross-section and is adapted to receive and hold bits and to release bits (e.g., to allow the release of bits by hand removal). The main body of bit 20, 21, 22 or 25 has a hexagonal cross-section for a fit into the bit-holding opening. If desired and as well known in the prior art, the bits can be fitted with spring balls, resilient rings, magnets or other devices to improve or enhance the fit of the bit into the opening. Typically, a bit is placed by hand into the opening and removed by hand from the opening. By being sized and shaped to allow the bit to be inserted into the opening, the opening is adapted to receive the bit. By being adapted to allow removal by hand, the opening is adapted to release the bit. Other release mechanisms known now or in the future can be employed. The invention is not limited to the bit-holding adaptations or mechanism shown in the drawings or described above as any adaptation or mechanism capable of holding (temporarily or permanently) a bit on the end of a arm or elongated member can be used in the practice of this invention. For example (but not preferred), the arm or elongated member can have at its end a threaded cylindrical portion onto which a threaded (single-headed) bit is screwed. Any conventional, known or future mechanism for holding a bit at the end of a arm or elongated member can be used, provided that the holding accomplished by the mechanism is suitable to serve the intended uses of this inventive handtool. It is preferred that the holding of the bit not be permanent, but rather that the bit can be released (i.e., removed) to allow flexibility and variety in the use of bits. The exposed heads or ends of the bits can be covered with protective caps (not shown).

The bit holding end of each arm 4 or 5 is the end that is opposite to the fixed point (defined by pin 14) at which arm 4 or 5 (through plate 10 or 11) is rotatably attached to elongated member 1.

The bits are preferably double-headed bits. A double headed bit has a bit tool (or bit head) at each end of the bit. A double headed bit 21 is shown in FIG. 6. Double-headed bits are preferred because they are reversible and give the user of the handtool a greater number of available tool options without the need for carrying extra bits. A double-headed bit can be removed from the end of the arm or elongated member, reversed and reinserted to make a different bit tool (bit head) available for use. Because double headed bits can be held on both ends of reversible blade 3 and because each arm can hold a double headed bit, the number of bit tools available to the user of the handtool is eight. This creates an "eight bit tool capability" or an "8 in 1" handtool. There is no preferred selection of bits (as such preference is a matter of choice by the user) but one useful selection of double-headed screwdriver bits is comprised of the numbers 1, 2 and 3 Phillips heads paired respectively with the number 6 slotted, number 4 slotted and number 10 slotted flat-heads. The bits useful in this invention are not limited to screwdriver head bits and can include any other kind of bit or tool (for example, socket wrench heads, Allen wrench, butterfly, torque, star and other bit tips).

An open portion 40 (see FIG. 2) of handle 2 is open, hollow and adapted to receive arm 4 when arm 4 is rotated towards and into elongated member 1. A open portion 41 (see FIG. 3) of handle 2 is open, hollow and adapted to receive arm 5 when arm 5 is rotated towards and into elongated member 1. As shown in FIGS. 1 and 7, arm 4 has been rotated towards and into open portion 40 of handle 2, and is positioned in the open portion 40 as shown in these Figures. The outer or exposed portion of arm 4, when the arm is received or positioned in the open portion 40, can function as additional rib similar to ribs 19 of handle 2. The arm 4 is preferably sized and shaped (for example, as in the Figures) such that when it is received or positioned in the open portion 40, the outer or exposed portion of arm 4 substantially conforms to ribs 19 in size and shape. This paragraph also applies in a similar manner to arm 5 and open portion 41. When arms 4 and 5 are received or positioned in open portions 40 and 41 of handle 2 (or of elongated member 1), they serve as ribs similar to ribs 19 and complete the pattern of ribs by supplying ribs to the areas occupied by open portions 40 and 41 which are otherwise not occupied by ribs.

Each of arms 4 and 5 can be rotated independent of the other arm. FIG. 1 shows arm 4 in a "closed position" (i.e., it is in open portion 40). Arm 4 can be rotated away from elongated member 1 to a "perpendicular position" as shown in FIG. 2. In a perpendicular position, the arm is substantially perpendicular to elongated member 1. Arm 4 can be rotated away from elongated member 1 beyond the perpendicular position to an "extended position" as shown in FIGS. 4 and 6. An extended position means a position that forms an angle between the arm 4 and elongated member 1 that is greater than 90 degrees but not more than 180 degrees. For example, when arm 4 is at about 135 degrees (as shown by 4*a* in FIG. 4) or at about 180 degrees (as shown by 4*b* in FIG. 4), the arm is at an extended position. An "intermediate extended position" means an extended position greater than a perpendicular position but less than about 180 degrees. This paragraph also applies to arm 5 in a similar manner. In the preferred embodiment shown in the drawings, only one of the arms can be in an extended position at the same time. Both arms can be in a perpendicular position at the same time, as shown in FIG. 4. When arm 4 is in the 180 degree position indicated by 4*b* in FIG. 4, Arm 5 must be in a closed position as indicated by 5*a* in FIG. 4.

An intermediate extended position, such as shown by 4*a* in FIG. 4, allows the user of the handtool to grasp handle 2 (typically with the other arm in a closed position such as 5*a* in FIG. 4) and use the extended arm (e.g., 4*a*) and its bit (e.g., bit 21) to turn or act on a screw or other device at an angle required by the circumstances.

As shown in FIG. 4, arm 4 and arm 5 can simultaneously be in their perpendicular positions to form with elongated member 1 a "T shape" which can be hand-held and which provides increased torque for turning a bit at the end of said elongated member. This torque makes it easier to turn a screw or other device. When the inventive handtool assumes this T shape, it is capable of producing a great deal more torque than a normal screwdriver or socket set. The T shape also provides more turning radius than a standard screwdriver or socket set or handle 2 when arms 4 and 5 are in a closed position. Considering its greater turning radius, the T shape of the inventive handtool can apply the increased torque for a longer period of time in each rotation. When used in a T shape, arms 4 and 5 can be placed across the palm of the hand with elongated member 1 extending perpendicularly outwardly with two fingers on either side. An optional position has arms 4 and 5 placed below the index finger. Other holding techniques or positions can be used as desired by the user. When high torque is not necessary, the handtool can be used with the arms closed as in FIG. 1 and handle 2 can be twisted by hand in a conventional manner.

As arm 4 and its plate 10 rotate, the arm can assume a perpendicular position, any extended position or a position between a perpendicular position and a closed position. The wave washer 43 provides a friction fit that facilitates this. More generally and in other embodiments of the invention, other friction fits, screws, or other mechanisms can allow an arm to hold whichever position (including an intermediate position) it is given by the user of the handtool. It is preferred, however, to include a mechanism that can better secure arm 4 to pre-determined positions. As shown in FIGS. 4 and 5 this can be accomplished by a spring, ball and detent mechanism. Plate 10 has detents 62, 63 and 64 which are concave areas sized and shaped to receive ball 46. A set screw 44 (or other retainer such as a plug or dimple) secures spring 45 and ball 46 in place. Spring 45 forces ball 46 into a detent when the detent is rotated over the ball, thus providing a more secure (but not permanent) hold. Detent 62 pre-determines a perpendicular position for arm 4. Detent 63 predetermines an extended position of about 135 degrees for arm 4. Detent 64 pre-determines an extended position of about 180 degrees for arm 4. When a arm is secured to a pre-determined position (i.e., a ball is in the detent corresponding to that position), rotation of arm 4 can be forced, for example by hand, to provide sufficient force to dislodge the ball from the detent and to rotate arm 4 to a different position. Preferably, the mechanism of securing arm 4 to a pre-determined position (e.g., by spring, ball and detent) should not be so secure as to make it difficult to rotate arm 4 to a different position by hand. Other mechanisms for securing an arm to one or more pre-determined positions include a key and tumbler mechanism, a spring loaded ball mechanism, a selection pin mechanism, a cam mechanism, a lever mechanism, etc. Any known or future mechanism that can be adapted to this purpose can be used as the mechanism. This paragraph also applies to arm 5 and plate 11 in a similar manner.

In FIG. 6 an alternative plate 70 is shown. Plate 70 does not have the spring, ball and detent mechanism of plate 10. Instead, plate 70 has a pin 72 and an open slot 71. Pin 72 is positioned in open slot 71. As arm 4 and plate 70 are rotated, the position of pin 72 in open slot 71 changes. Open slot 71 restricts the rotation of plate 70 and thereby restricts the rotation of arm 4 to the range of positions allowed by the open slot. In this embodiment, arm 4 is restricted to positions ranging from a perpendicular position to a closed position. Extended positions are not permitted by the open slot. The open slot could be increased in circular length to increase the arc of rotation to include extended positions for arm 4. This paragraph applies to arm 5 in a similar manner.

The dimensions of the handtool can vary widely and this invention is not limited to specific dimensions. In the preferred embodiment shown in the Figures, the elongated member (excluding bits) is about seven inches long and the arms (excluding bits) together in a T shape as in FIG. 2 are about four and three-eighths inches long in combined length.

It is further understood that there are embodiments of this invention that will be obvious to one skilled in the art in view of the foregoing specification, and it is intended that these embodiments be included within the scope of this invention, which scope is limited only by the scope of the appended claims.

I claim:

1. A handtool comprising:

(a) an elongated member adapted to hold a bit at an end of said elongated member;

(b) a first arm rotatably attached at a fixed point to said elongated member;

(c) a second arm rotatably attached at a fixed point to said elongated member;

wherein:

(i) said first arm can be rotated about its fixed point to a position that is substantially perpendicular to said elongated member and said first arm can be rotated about its fixed point from its perpendicular position towards the elongated member;

(ii) said second arm can be rotated about its fixed point to a position that is substantially perpendicular to said elongated member and said second arm can be rotated about its fixed point from its perpendicular position towards the elongated member;

(iii) each of said arms can be rotated independent of the rotation of the other arm;

(iv) at least one of said arms can be rotated away from the elongated member and beyond a perpendicular position to at least one pre-determined extended position relative to the elongated member; and (v) said handtool further comprises a mechanism to secure said at least one of said arms to said at least one pre-determined extended position.

2. A handtool in accordance with claim 1 wherein said at least one pre-determined extended position is an intermediate extended position between a perpendicular position and a 180 degree position relative to the elongated member.

3. A handtool in accordance with claim 2 wherein said first arm and said second arm are rotatable on opposite sides of the elongated member and said first arm and said second arm can simultaneously be in their perpendicular positions to form with said elongated member a T shape which can be hand-held and which provides increased torque for turning a bit at the end of said elongated member; and wherein said first arm is adapted to hold a bit at an end of said first arm and second arm is adapted to hold a bit at an end of said second arm; and wherein the bit holding end of each arm is opposite the fixed point at which the arm is rotatably attached.

4. A handtool in accordance with claim 3 wherein said elongated member is adapted to receive, hold and release a bit at the bit holding end of said elongated member; wherein said first arm is adapted to receive, hold and release a bit at the bit holding end of said first arm; and wherein said second arm is adapted to receive, hold and release a bit at the bit holding end of said second arm.

5. A handtool in accordance with claim 4 wherein the elongated member is comprised of a handle and a blade; wherein the first arm and second arm are rotatably attached to the handle; wherein the blade extends from the handle and includes the bit holding end of the elongated member; wherein the handle is adapted to receive, hold and release the blade; and wherein the blade is reversible and is adapted to hold a bit on each end of the blade.

6. A handtool in accordance with claim 2 wherein said elongated member has a first open portion adapted to receive the first arm when it is rotated into the elongated member; and wherein said elongated member has a second open portion adapted to receive the second arm when it is rotated into the elongated member.

7. A handtool in accordance with claim 1 wherein either of said arms can be rotated away from the elongated member and beyond a perpendicular position to at least one predetermined extended position relative to the elongated member; and wherein said handtool further comprises a mechanism for each of said arms to secure the arm to its said pre-determined extended position.

8. A handtool in accordance with claim 7 wherein said predetermined extended position to which either of said arms can be rotated is an intermediate extended position between a perpendicular position and a 180 degree position relative to the elongated member.

9. A handtool in accordance with claim 8 wherein each arm is rotatable about substantially the same axis of rotation.

10. A handtool in accordance with claim 7 wherein said mechanism is a spring, ball and detent mechanism.

11. A handtool in accordance with claim 1 wherein each arm is rotatably attached to said elongated member through a plate affixed to the arm; wherein as each arm rotates its plate rotates; and wherein the plates are substantially parallel to each other.

12. A handtool comprising:

(a) an elongated member adapted to hold a bit at an end of said elongated member;

(b) a first arm rotatably attached at a fixed point to said elongated member;

(c) a second arm rotatably attached at a fixed point to said elongated member, wherein:

(i) said first arm can be rotated about its fixed point to a position that is substantially perpendicular to said elongated member and said first arm can be rotated about its fixed point from its perpendicular position towards the elongated member;

(ii) said second arm can be rotated about its fixed point to a position that is substantially perpendicular to said elongated member and said second arm can be rotated about its fixed point from its perpendicular position towards the elongated member;

(iii) each of said arms can be rotated independent of the rotation of the other arm; and (iv) each of said arms is rotatable about substantially the same axis of rotation.

13. A handtool in accordance with claim 12 wherein said axis of rotation is defined by the fixed point of the first arm and the fixed point of the second arm.

14. A handtool in accordance with claim 13 wherein each arm is rotatably attached to said elongated member through a plate affixed to the arm.

15. A handtool in accordance with claim 14 wherein each plate includes a hole and said elongated member includes a hole; wherein the holes are aligned; wherein a pin is positioned through said aligned holes to rotatably attach said arms to said elongated member; wherein said pin defines said axis of rotation.

16. A handtool in accordance with claim 14 wherein as each arm rotates its plate rotates; wherein the plates are substantially parallel to each other; and wherein the plates rotate about said axis of rotation.

17. A handtool in accordance with claim 12 wherein said first arm and said second arm are rotatable on opposite sides of the elongated member and said first arm and said second arm can simultaneously be in their perpendicular positions to form with said elongated member a T shape which can be hand-held and which provides increased torque for tuning a bit at the end of said elongated member.

18. A handtool in accordance with claim 12 wherein said first arm is adapted to hold a bit at an end of said first arm and said second arm is adapted to hold a bit at an end of said second arm; and wherein the bit holding end of each arm is opposite the fixed point at which the arm is rotatably attached.

19. A handtool in accordance with claim 12 wherein said elongated member is adapted to receive, hold and release a bit at the bit holding end of said elongated member; wherein said first arm is adapted to receive, hold and release a bit at the bit holding end of said first arm; and wherein said second arm is adapted to receive, hold and release a bit at the bit holding end of said second arm.

20. A handtool in accordance with claim 12 wherein said elongated member has a first open portion adapted to receive the first arm when it is rotated into the elongated member; and wherein said elongated member has a second open portion adapted to receive the second arm when it is rotated into the elongated member.

21. A handtool in accordance with claim 20 wherein the elongated member is comprised of a handle and a blade; wherein the first arm and second arm are rotatably attached to the handle; wherein the blade extends from the handle and includes the bit holding end of the elongated member; wherein the handle is adapted to receive, hold and release the blade; and wherein the blade is reversible and is adapted to hold a bit on each end of the blade.

22. A handtool in accordance with claim 20 wherein either of said arms can be rotated away from the elongated member and beyond a perpendicular position to at least one extended position relative to the elongated member.

23. A handtool comprising:

(a) an elongated member adapted to hold a bit at an end of said elongated member;

(b) a first arm rotatably attached at a fixed point to said elongated member;

(c) a second arm rotatably attached at a fixed point to said elongated member;

wherein:

(i) said first arm can be rotated about its fixed point to a position that is substantially perpendicular to said elongated member and said first arm can be rotated about its fixed point from its perpendicular position towards the elongated member;

(ii) said second arm can be rotated about its fixed point to a position that is substantially perpendicular to said elongated member and said second arm can be rotated about its fixed point from its perpendicular position towards the elongated member;

(iii) each of said arms can be rotated independent of the rotation of the other arm; and (iv) each arm is rotatably attached to said elongated member through a plate affixed to the arm.

24. A handtool in accordance with claim 23 wherein each plate includes a hole and said elongated member includes a hole; wherein the holes are aligned; wherein a pin is positioned through said aligned holes to rotatably attach said arms to said elongated member; wherein said pin defines for each arm the fixed point of rotation; and wherein each arm can independently rotate about said pin.

25. A handtool in accordance with claim 23 wherein each plate is sized and shaped so that as the plate rotates with the rotation of its arm, the plate remains substantially flush with the end of the elongated member.

26. A handtool in accordance with claim 23 wherein as each arm rotates its plate rotates; wherein the plates are substantially parallel to each other; and wherein the plates rotate about substantially the same axis of rotation.

27. A handtool in accordance with claim 26 wherein the thickness of each plate is about one-half the thickness of the arm to which the plate is affixed.

28. A handtool in accordance with claim 23 wherein said first arm and said second arm are rotatable on opposite sides of the elongated member and said first arm and said second arm can simultaneously be in their perpendicular positions to form with said elongated member a T shape which can be hand-held and which provides increased torque for turning a bit at the end of said elongated member.

29. A handtool in accordance with claim 23 wherein said first arm is adapted to hold a bit at an end of said first arm and said second arm is adapted to hold a bit at an end of said second arm; and wherein the bit holding end of each arm is opposite the fixed point at which the arm is rotatably attached.

30. A handtool in accordance with claim 29 wherein said elongated member is adapted to receive, hold and release a bit at the bit holding end of said elongated member; wherein said first arm is adapted to receive, hold and release a bit at the bit holding end of said first arm; and wherein said second arm is adapted to receive, hold and release a bit at the bit holding end of said second arm.

31. A handtool in accordance with claim 23 wherein said elongated member has a first open portion adapted to receive the first arm when it is rotated into the elongated member; and wherein said elongated member has a second open portion adapted to receive the second arm when it is rotated into the elongated member.

32. A handtool in accordance with claim 31 wherein the elongated member is comprised of a handle and a blade; wherein the first arm and second arm are rotatably attached to the handle; wherein the blade extends from the handle and includes the bit holding end of the elongated member; wherein the handle is adapted to receive, hold and release the blade; and wherein the blade is reversible and is adapted to hold a bit on each end of the blade.

33. A handtool in accordance with claim 12 wherein as each arm rotates its plate rotates; and wherein the plates are substantially parallel to each other.

34. A handtool in accordance with claim 23 wherein the plate is affixed to the arm by being integral with the arm and forming a single integral piece comprised of an arm portion and a plate portion.

35. A handtool comprising:

(a) an elongated member adapted to hold a bit at an end of said elongated member;

(b) a first arm rotatably attached at a fixed point to said elongated member;

(c) a second arm rotatably attached at a fixed point to said elongated member;

wherein:

(i) said first arm can be rotated about its fixed point to a position that is substantially perpendicular to said elongated member and said first arm can be rotated about its fixed point from its perpendicular position towards the elongated member, (ii) said second arm can be rotated about its fixed point to a position that is substantially perpendicular to said elongated member and said second arm can be rotated about its fixed point from its perpendicular position towards the elongated member;

(iii) each of said arms can be rotated independently of the rotation of the other arm;

(iv) said first arm and said second arm are rotatable on opposite sides of the elongated member;

(v) the elongated member is comprised of a handle and a blade;

(vi) said first arm and second arm are rotatably attached to said handle;

(vii) said blade extends from the handle and includes the bit holding end of the elongated member;

(viii) said blade is adapted to receive, hold and release a bit at the bit holding end of said blade;

(ix) said handle has a first open portion adapted to receive the first arm when it is rotated into said handle, and said handle has a second open portion adapted to receive the second arm when it is rotated into said handle;

(x) said handle has ribs extending from said handle and running parallel to the length of said handle;

(xi) when said arms are in a closed position, said arms complete the pattern of ribs by supplying ribs to the areas occupied by said first open portion and said second open portion.

36. A handtool in accordance with claim 35 wherein when said arms are in a closed position, the exposed portions of said arms substantially conform in size and shape to the ribs.

37. A handtool in accordance with claim 36 wherein the ribs are rounded, but the rounding is truncated in a manner that defines a circle shape.

38. A handtool in accordance with claim 36 wherein:

(xii) said first arm is adapted to hold a bit at an end of said first arm and said second arm is adapted to hold a bit at an end of said second arm; and wherein the bit holding end of each arm is opposite the fixed point at which the arm is rotatably attached; and (xiii) said first arm is adapted to receive, hold and release a bit at the bit holding end of said first arm, and said second arm is adapted to receive, hold and release a bit at the holding end of said arm.

39. A handtool comprising:

(a) an elongated member adapted to hold a bit at an end of said elongated member;

(b) a first arm rotatably attached at a fixed point to said elongated member;

(c) a second arm rotatably attached at a fixed point to said elongated member;

wherein:

(i) said first arm can be rotated about its fixed point to a position that is substantially perpendicular to said elongated member and said first arm can be rotated about its fixed point from its perpendicular position towards the elongated member;

(ii) said second arm can be rotated about its fixed point to a position that is substantially perpendicular to said elongated member and said second arm can be rotated about its fixed point from its perpendicular position towards the elongated member;

(iii) each of said arms can be rotated independent of the rotation of the other arm;

(iv) said first arm and said second arm are rotatable on opposite sides of the elongated member;

(v) said first arm and said second arm can simultaneously be in their perpendicular positions to form with said elongated member a T shape which can be hand-held and which provides increased torque for turning a bit at the end of said elongated member; and (vi) said handtool further comprises (d) a mechanism to secure each of said arms to its perpendicular position.

40. A handtool in accordance with claim 39 wherein said mechanism of (vi) is a spring, ball and detent mechanism.

41. A handtool in accordance with claim 39 wherein (vii) said first arm is adapted to hold a bit at an end of said first arm and said second arm is adapted to hold a bit at an end of said second arm;

(viii) wherein the bit holding end of each arm is opposite the fixed point at which the arm is rotatably attached;

(ix) said elongated member is adapted to receive, hold and release a bit at the bit holding end of said elongated member;

(x) wherein said first arm is adapted to receive, hold and release a bit at the bit holding end of said first arm;

(xi) said second arm is adapted to receive, hold and release a bit at the bit holding end of said second arm;

(xii) said elongated member has a first open portion adapted to receive the first arm when it is rotated in to the elongated member; and wherein said elongated member has a second open portion adapted to receive the second arm when it is rotated into the elongated member;

(xiii) said elongated member is comprised of a handle and a blade; wherein the first arm and second arm are rotatably attached to the handle; wherein the blade extends from the handle and includes the bit holding end of the elongated member; wherein the handle is adapted to receive, hold and release the blade; and wherein the blade is reversible and is adapted to hold a bit on each end of the blade;

(xiv) each arm is rotatable about substantially the same axis of rotation; and (xv) each arm is rotatably attached to said elongated member through a plate affixed to the arm; wherein as each arm rotates its plate rotates; wherein the plates are substantially parallel to each other; and wherein the plates rotate about substantially the same axis of rotation.

42. A handtool in accordance with claim 41 wherein:

(xvi) the handle has ribs extending from said handle and running parallel to the length of said handle; and (xvii) exposed portions of said arms substantially conform in size and shape to the ribs when said arms are positioned in said open portions of (xii) after said arms have been rotated into said open portions.

43. A handtool in accordance with claim 42 wherein the ribs are rounded, but the rounding is truncated in a manner that defines a circle shape.

* * * * *